US011141873B2

(12) United States Patent
Hodgson

(10) Patent No.: US 11,141,873 B2
(45) Date of Patent: Oct. 12, 2021

(54) SHAVING RAZOR SYSTEM

(71) Applicant: The Gillette Company LLC, Boston, MA (US)

(72) Inventor: Matthew James Hodgson, Ramsbury (GB)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 15/951,323

(22) Filed: Apr. 12, 2018

(65) Prior Publication Data

US 2018/0297223 A1 Oct. 18, 2018

Related U.S. Application Data

(60) Provisional application No. 62/486,636, filed on Apr. 18, 2017.

(51) Int. Cl.
*B26B 21/44* (2006.01)
*B26B 21/52* (2006.01)

(52) U.S. Cl.
CPC ..... *B26B 21/446* (2013.01); *B26B 21/521* (2013.01); *B26B 21/522* (2013.01)

(58) Field of Classification Search
CPC ..... B26B 21/446; B26B 21/521; B26B 21/44; B26B 21/52–21/522
USPC ..... 30/41, 526, 532, 535, 41.5, 47–51; D9/697; D28/46, 47
See application file for complete search history.

(56) References Cited

U.S. PATENT DOCUMENTS 1,370,665 A * 3/1921 Moore ..... B65D 41/26 222/92
1,433,167 A * 10/1922 Worden ..... B65D 35/565 222/105
1,581,469 A 4/1926 Oskin
D70,518 S * 7/1926 Vaughan ..... D9/697
1,673,590 A * 6/1928 Redheffer ..... B26B 21/446 30/41
1,836,800 A 12/1931 Hope
1,950,769 A 3/1934 Baar
1,978,455 A * 10/1934 Geerlings ..... B65D 35/44 222/92
D99,424 S * 4/1936 De Vaulchier ..... D9/697
(Continued)

FOREIGN PATENT DOCUMENTS

CA 2570867 C * 7/2008 ..... B26B 21/521
CN 2044927 U * 9/1989 ..... B26B 21/44
(Continued)

OTHER PUBLICATIONS

International Search Report for PCT/US2018/027438 dated Jul. 2, 2018, 14 pages.

*Primary Examiner* — Jason Daniel Prone
(74) *Attorney, Agent, or Firm* — John M. Lipchitz

(57) ABSTRACT

A shaving razor system with a tottle defining a cavity for containing a liquid. The tottle has a first end defining a fluid port and a second end having a seal. The tottle has a maximum cross-sectional area between the first end and the second end. A coupler at the second end of the tottle is configured to engage a personal care article. An end cap is mounted to the first end of the tottle. The end cap has a bottom surface with a contact area greater than the maximum cross-sectional area between the first end and the second end of the tottle.

17 Claims, 10 Drawing Sheets

(56) References Cited

U.S. PATENT DOCUMENTS 2,300,512 A * 11/1942 Landau ..... B26B 21/446 30/41
2,632,446 A 3/1953 Rosenzweig
2,818,872 A 1/1958 Wang
3,045,343 A 7/1962 Baruch
3,078,017 A * 2/1963 Waskonig ..... B65D 35/245 222/181.3
3,488,764 A 1/1970 Welsh
3,492,723 A * 2/1970 Mollica ..... B26B 21/06 30/47
3,593,416 A 7/1971 Edson
3,777,396 A 12/1973 Simonetti
3,985,146 A * 10/1976 Albach ..... A45D 27/00 132/289
4,129,942 A 12/1978 Denizman
4,433,483 A 2/1984 Lazarus
4,446,619 A * 5/1984 Jacobson ..... B26B 21/521 30/47
4,470,521 A 9/1984 Scammell
D281,282 S 11/1985 Lazarus
4,562,643 A 1/1986 Cataudella
4,573,266 A 3/1986 Jacobson
4,625,402 A 12/1986 Kavoussi
4,635,361 A 1/1987 DeMars
4,696,106 A 9/1987 Cross et al.
4,716,652 A 1/1988 Cataudella
D294,661 S 3/1988 Kang
4,753,006 A 6/1988 Howe
4,791,723 A 12/1988 Jacobson
4,809,432 A 3/1989 Schauble
4,813,138 A 3/1989 Chen
4,868,982 A * 9/1989 McComas ..... B26B 21/446 30/41
4,881,323 A 11/1989 McGaughan
D306,496 S * 3/1990 Newberry, Jr. ..... D28/48
D309,036 S 7/1990 Cheng
D310,271 S 8/1990 Jacobson
D311,784 S 10/1990 Schwartz
4,970,784 A 11/1990 Althaus et al.
4,974,319 A 12/1990 Maguire, Jr. et al.
D317,715 S * 6/1991 Bauwens ..... D9/697
5,070,611 A 12/1991 Derin et al.
5,083,336 A * 1/1992 Atsumi ..... A46B 5/0033 132/121
5,133,131 A 7/1992 Hoffman
5,269,062 A 12/1993 Dallaire et al.
5,274,922 A * 1/1994 Elliott ..... B26B 21/06 30/41
5,287,624 A 2/1994 Mondo et al.
5,318,203 A * 6/1994 Iaia ..... B65D 81/3288 222/94
5,403,534 A 4/1995 Kim
5,547,091 A * 8/1996 Neveras ..... B65D 35/14 215/237
D374,615 S * 10/1996 Kani ..... D9/697
5,579,580 A 12/1996 Althaus et al.
5,655,302 A * 8/1997 Mroczka ..... B26B 21/446 30/41
5,661,907 A 9/1997 Apprille, Jr.
D392,879 S * 3/1998 Couey ..... D9/697
5,819,413 A * 10/1998 Kerbrat ..... B26B 21/523 30/47
5,855,066 A * 1/1999 Manger ..... B26B 21/446 30/41
5,983,500 A * 11/1999 da Silva ..... B26B 21/446 30/125
6,053,184 A 4/2000 Devone
D426,917 S * 6/2000 Hokanson ..... D28/45
6,082,006 A * 7/2000 Cahan ..... B26B 21/523 30/47
6,164,290 A 12/2000 Andrews
D440,494 S * 4/2001 Sagel ..... D9/450
6,370,783 B1 4/2002 Bozikis et al.
6,434,828 B1 8/2002 Andrews
6,550,148 B2 4/2003 Cecil
6,665,937 B2 * 12/2003 Furst ..... B26B 19/40 222/192
D489,485 S 5/2004 Leventhal
6,754,958 B2 * 6/2004 Haws ..... B26B 21/446 222/399
D502,099 S * 2/2005 Lovell ..... D9/446
6,871,679 B2 * 3/2005 Last ..... B65D 75/5877 137/614.05
6,910,274 B1 * 6/2005 Pennella ..... B26B 21/446 30/41
6,986,207 B2 * 1/2006 Selek ..... B26B 21/40 132/289
7,051,439 B2 5/2006 Tomasetti
D525,526 S * 7/2006 Abbott ..... D9/449
7,086,160 B2 8/2006 Coffin et al.
7,121,754 B2 * 10/2006 Bressler ..... B26B 21/446 401/264
7,137,203 B2 * 11/2006 Bressler ..... B26B 21/446 30/41
7,178,241 B1 * 2/2007 Cummings ..... B26B 21/446 30/41
7,234,239 B2 * 6/2007 Saito ..... A45D 26/0028 30/41
D567,442 S * 4/2008 McMullan ..... D28/46
D602,634 S 10/2009 Cataudella
D615,417 S * 5/2010 Fallat, II ..... D9/695
7,788,809 B2 9/2010 Tomassetti
7,814,661 B2 10/2010 Tomassetti
7,818,883 B2 10/2010 Lax
D626,428 S * 11/2010 Fallat, II ..... D9/695
D626,860 S * 11/2010 Oates ..... D9/699
8,028,417 B1 * 10/2011 Hosseini ..... B65D 35/36 222/191
8,033,023 B2 10/2011 Johnson et al.
D660,516 S 5/2012 Christie
D662,416 S * 6/2012 Dziersk ..... D9/449
8,261,451 B2 9/2012 Macove
D669,220 S 10/2012 Otsuka
D675,377 S 1/2013 Boulanger
8,365,416 B2 2/2013 Rockell et al.
8,474,354 B2 7/2013 Horton
8,510,957 B2 * 8/2013 Wain ..... B26B 21/446 30/41
D693,237 S * 11/2013 Bates ..... D9/697
D696,461 S 12/2013 Prat-pfister
8,607,458 B2 * 12/2013 Hosseini ..... B26B 21/446 222/191
8,863,968 B2 * 10/2014 Giusti ..... B01L 3/50825 220/254.4
8,931,177 B2 * 1/2015 Wain ..... B26B 21/446 30/41
9,120,602 B2 9/2015 Lagace
D742,228 S * 11/2015 Dyer ..... D9/449
9,221,185 B2 12/2015 Walker, Jr.
D751,908 S * 3/2016 Lee ..... D9/552
D752,987 S * 4/2016 Dyer ..... D9/571
D756,235 S * 5/2016 Dyer ..... D9/571
9,434,079 B2 9/2016 Worrick, III
9,434,081 B2 9/2016 Kumar
9,579,809 B2 2/2017 Hawes
9,694,503 B2 7/2017 Papadopoulos-papageorgis et al.
9,833,916 B2 * 12/2017 Shorey ..... B26B 21/44
9,908,689 B2 * 3/2018 Schulz ..... B65D 83/0055
D839,477 S * 1/2019 Hodgson ..... D28/46
10,232,521 B2 * 3/2019 Wain ..... B26B 21/446
D873,150 S * 1/2020 Renard ..... D9/697
D882,873 S 4/2020 Goeder et al.
D887,642 S * 6/2020 Hodgson ..... D28/47
D913,593 S 3/2021 Hodgson
2003/0044313 A1 3/2003 Lee
2003/0196328 A1 10/2003 Andino et al.
2004/0016126 A1 1/2004 deBlois
2004/0172831 A1 9/2004 Paas et al.
2004/0177518 A1 9/2004 Leventhal
2004/0177519 A1 * 9/2004 Tomassetti ..... B26B 21/446 30/527

(56) References Cited

U.S. PATENT DOCUMENTS

2004/0206775 A1* 10/2004 Holmes ..... B65D 35/22 222/94
2004/0226178 A1 11/2004 Lukan et al.
2005/0120560 A1 6/2005 Franzini et al.
2005/0126008 A1 6/2005 Pennella
2005/0132574 A1 6/2005 Tomassetti
2005/0198830 A1 9/2005 Walker
2005/0198840 A1 9/2005 Worrick et al.
2005/0246906 A1 11/2005 Greene
2006/0150386 A1 7/2006 Wanli et al.
2006/0272154 A1* 12/2006 Brevard ..... B26B 21/446 30/41
2007/0017097 A1 1/2007 Scheindel
2007/0050983 A1 3/2007 Schnak et al.
2007/0251106 A1 11/2007 Gladstone
2008/0022529 A1 1/2008 Gray
2008/0034591 A1 2/2008 Fung
2008/0201966 A1 8/2008 Psimadas et al.
2008/0307653 A1 12/2008 Wattam
2009/0038737 A1* 2/2009 Previty ..... B65C 9/26 156/86
2009/0113730 A1 5/2009 Psimadas et al.
2009/0126197 A1 5/2009 Tomassetti
2009/0249628 A1 10/2009 Hosseini et al.
2009/0297460 A1 12/2009 Lamb et al.
2010/0077622 A1 4/2010 Schulz
2010/0175261 A1 7/2010 Lax
2010/0175270 A1 7/2010 Psimadas et al.
2010/0205808 A1 8/2010 King
2010/0236071 A1 9/2010 Szczepanowski et al.
2010/0236072 A1 9/2010 Szczepanowski
2011/0023310 A1 2/2011 Psimadas et al.
2011/0036371 A1 2/2011 Marroncles et al.
2011/0146080 A1* 6/2011 Pauw ..... B26B 21/446 30/41.5
2011/0162209 A1 7/2011 Wain
2011/0180567 A1 7/2011 Bender et al.
2011/0197446 A1 8/2011 Macove
2011/0203112 A1 8/2011 Lax
2012/0023762 A1 2/2012 Furuta
2012/0094051 A1 4/2012 Chang
2012/0096718 A1 4/2012 Howell et al.
2012/0103362 A1* 5/2012 Nowacek ..... A45D 42/08 132/291
2012/0198698 A1 8/2012 Szczepanowski et al.
2012/0233868 A1 9/2012 Bridges et al.
2012/0255185 A1 10/2012 Patel et al.
2012/0291290 A1 11/2012 Fishman et al.
2013/0061481 A1 3/2013 Cooney
2013/0081276 A1 4/2013 Wain
2013/0081291 A1 4/2013 Wain
2013/0145625 A1 6/2013 Xu et al.
2013/0160305 A1 6/2013 Howell
2013/0255088 A1 10/2013 Christie et al.
2013/0341354 A1* 12/2013 Archer ..... A47K 5/1201 222/105
2014/0083265 A1 3/2014 Provost
2014/0216215 A1 8/2014 Hosseini et al.
2014/0290066 A1 10/2014 Woolfson et al.
2015/0121703 A1 5/2015 Bridges et al.
2015/0197021 A1 7/2015 Hodgson
2015/0239138 A1 8/2015 Kurzet et al.
2015/0259097 A1 9/2015 O'hare
2015/0266191 A1 9/2015 Maimone et al.
2015/0328787 A1 11/2015 Ortins
2016/0167242 A1 6/2016 Noh et al.
2016/0250766 A1 9/2016 Gratsias
2017/0001320 A1* 1/2017 Hodgson ..... B26B 21/446
2017/0001321 A1* 1/2017 Shorey ..... B26B 21/4037
2017/0066148 A1 3/2017 Hodgson et al.
2017/0112002 A1 4/2017 Behrendt
2017/0264036 A1 9/2017 Broemse
2017/0282390 A1 10/2017 Hodgson
2017/0326743 A1 11/2017 Hodgson
2017/0368702 A1 12/2017 Wain et al.
2018/0115339 A1 4/2018 Altschul et al.
2018/0168052 A1 6/2018 Behrendt et al.
2018/0194027 A1* 7/2018 Tews ..... B26B 21/446
2018/0297220 A1* 10/2018 Hodgson ..... B26B 21/446
2018/0297221 A1* 10/2018 Hodgson ..... B26B 21/522
2018/0297222 A1* 10/2018 Hodgson ..... B26B 21/522
2018/0297225 A1* 10/2018 Hodgson ..... B26B 21/522
2019/0077033 A1 3/2019 Hodgson
2020/0047361 A1* 2/2020 Valcov ..... B26B 21/446
2020/0254639 A1* 8/2020 Bridges ..... B26B 21/446

FOREIGN PATENT DOCUMENTS

CN 2130660 Y * 4/1993 ..... B26B 21/44
CN 202507311 U * 10/2012 ..... B26B 21/44
CN 104053527 A * 9/2014 ..... B26B 21/446
DE 29711818 U1 * 9/1997 ..... B26B 21/446
EP 0123765 A1 11/1984
EP 0101767 B1 4/1988
WO WO97018065 5/1997
WO WO2003006217 A1 1/2003
WO WO2009019521 A4 4/2009
WO WO-2014030990 A1 * 2/2014 ..... B26B 21/446
WO WO-2016020009 A1 * 2/2016 ..... B26B 21/522

* cited by examiner

SHAVING RAZOR SYSTEM

FIELD OF THE INVENTION

The present invention relates to personal care articles and more particularly to shaving razor systems that have a shaving razor cartridge mounted to an ergonomically formed handle for shaving another person's face.

BACKGROUND OF THE INVENTION

In general, a cartridge or blade unit of a safety razor has at least one blade with a cutting edge which is moved across the surface of the skin being shaved by means of a handle to which the cartridge is attached. Some shaving razors are provided with a spring biased cartridge that pivots relative to the handle to follow the contours of the skin during shaving. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled.

Razor blade assemblies have been disclosed wherein cutting-edge portions of the blade members are held between skin engaging surfaces which are generally referred to as the guard and cap of the razor blade assembly. The guard contacts the skin in front of the blade member(s) and the cap contacts the skin behind the blade member(s) during a shaving stroke. The cap and guard may aid in establishing the so-called "shaving geometry", i.e., the parameters which determine the blade orientation and position relative to the skin during shaving, which in turn have a strong influence on the shaving performance and efficacy of the razor. The cap may comprise a water leachable shaving aid to reduce drag and improve comfort. The guard may be generally rigid, for example formed integrally with a frame or platform structure which provides a support for the blades. Guards may also comprise softer elastomeric materials to improve skin stretching.

Personal care givers often care for individuals who are unable to shave themselves because of decreased mental and/or physical capacity often brought about by chronic age, injury, or various degenerative diseases. The task of shaving another person requires extreme care, patience, coordination and spatial awareness to avoid cutting the person being shaved. In the United States, barbers are licensed and often have years of experience shaving other people. However, close family members and professional care givers are much less familiar with shaving techniques for shaving another person. Furthermore, barbers typically use a straight edge razor, which would be very dangerous for a personal care giver or family member to attempt using on another person without proper training. Wet safety razor shaving systems have been enhanced for over one hundred years for self-application. However, these designs are suboptimal for shaving another person. In addition, the shaving razor cartridge must be kept clean in between shaving strokes. Current shaving razor systems are designed to lie down (i.e., horizontally) on a flat surface, thus the cartridge may potentially contact an unsanitary surface, which may result in an infection which could be potentially deadly to older or disabled people with compromised immune systems.

Tottles are typically used for dispensing various types of fluid compositions for personal care products. However, there are no simple and intuitive methods for attaching a personal care article to a tottle. Thus, there is a need for an easy method and apparatus for attaching a personal care article to a tottle in a simple, efficient and secure manner by either the original manufacturer or the consumer.

Thus, there is a need for a shaving razor cartridge mounted to an ergonomic handle to allow for proper control, grip and manipulation for shaving another person's face, as well as easily stand up in a vertical position.

SUMMARY OF THE INVENTION

In one aspect, the invention features, in general a shaving razor system with a tottle defining a cavity for containing a liquid. The tottle has a first end defining a fluid port and a second end having a seal. The tottle has a maximum cross-sectional area between the first end and the second end. A coupler at the second end of the tottle is configured to engage a personal care article. An end cap is mounted to the first end of the tottle. The end cap has a bottom surface with a contact area greater than the maximum cross-sectional area between the first end and the second end of the tottle.

BRIEF DESCRIPTION OF THE DRAWINGS

Other features and advantages of the present invention, as well as the invention itself, can be more fully understood from the following description of the various embodiments, when read together with the accompanying drawings, in which.

DETAILED DESCRIPTION OF THE INVENTION

Figure 1:
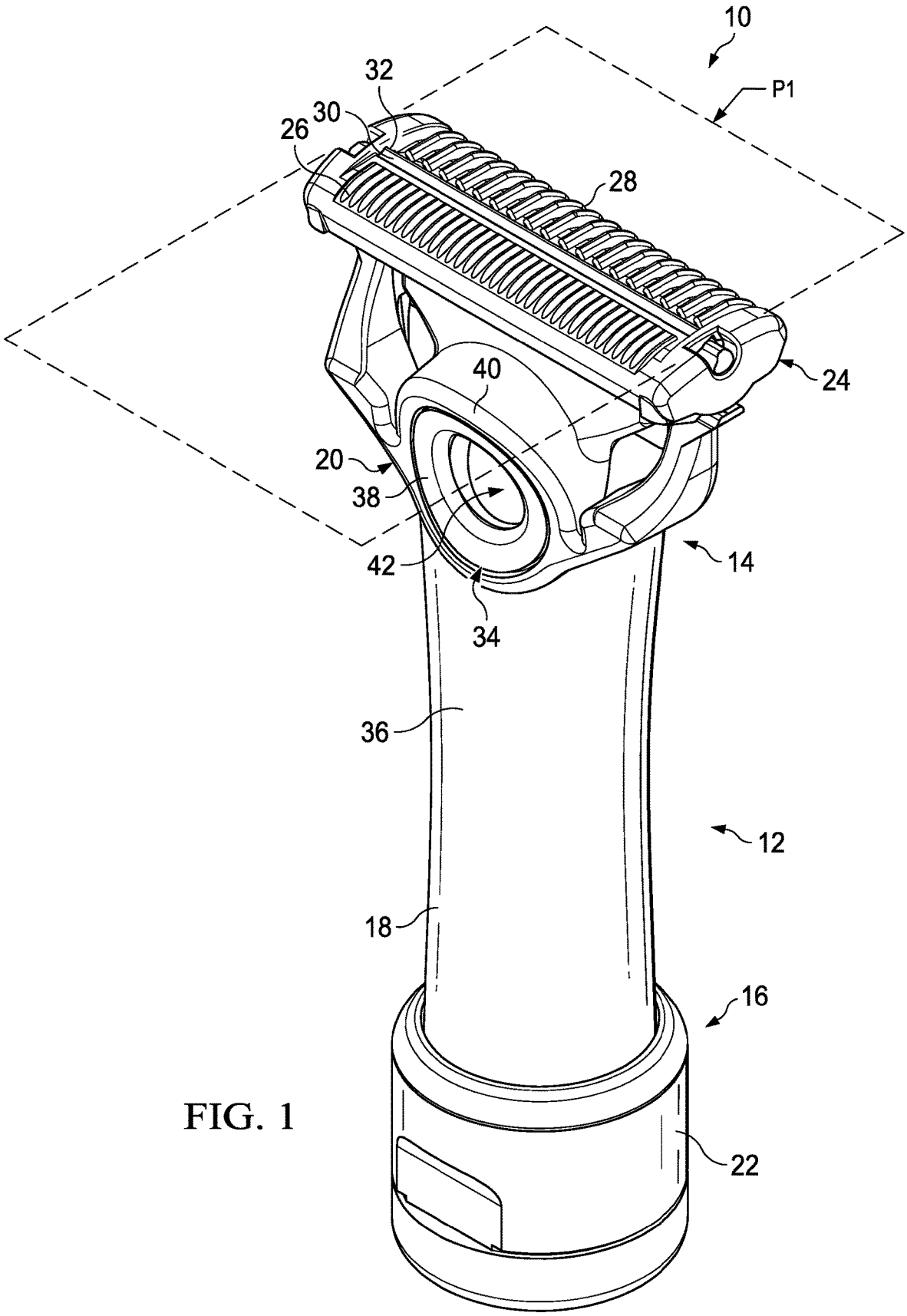
FIG. 1 is a perspective view of a shaving razor system according to one possible embodiment of the present invention.

Referring to FIG. 1, a perspective view is shown of a shaving razor system 10. The shaving razor system 10 may include a handle 12 having a first end 14 and a second end 16. In certain embodiments, the handle 12 may include a flexible tottle 18 for containing a liquid, such as a pre- or post-shaving aid composition. A tottle is an industry word for a type of bottle (often used for ketchup, shampoo, etc.) that sits on a cap at the end. For example, a "bottle" sits on its "bottom" and dispenses a liquid from the opposite end (top) which has a cap, a "tottle" sits on its "top," which is the end that dispenses a liquid and has the end cap. The handle 12 may also include a coupler 20 mounted to the first end 14 of the handle 12 and an end cap 22 (e.g., removable cover or flip top) at the second end 16 of the handle 12 to prevent fluid from exiting the handle 12. A shaving razor cartridge 24 may be mounted to the coupler 20. The shaving razor cartridge 24 may include a cap 26, a guard 28 and a blade 30 having a cutting edge 32 positioned between the cap 26 and the guard 28. The cap 26 and the guard 28 may establish a shaving plane P1 (i.e., plane tangent to the cap 26 and the guard 28).

The coupler 20 may include a finger pad 34 on a top surface 36 of the handle 12 (e.g., the tottle 18) for receiving and properly positioning a user's finger or thumb. The finger pad 34 may be circular and have a large radius to receive the thumb of a user or better maintain a user's finger on the finger pad 34. For example, the finger pad 34 may have a radius of about 5 mm to about 15 mm. The finger pad 34 may also have a concave top surface 38 and a forward rim 40. The shaving razor cartridge 24 may be positioned in front of the forward rim 40 of the finger pad 34 (e.g., to facilitate aiming the shaving razor cartridge 24 in the direction of another person's face during shaving). The concave surface 38 may arc in an upward direction and have a radius of about 7 mm to about 25 mm. In certain embodiments, the finger pad 34 may define an opening 42 extending completely through the finger pad 34 to the top surface 36 of the handle 12 (e.g., tottle 18) thus allowing the user's finger or thumb to rest deeper within the finger pad 34. The top surface 36 of the tottle 18 at a bottom of the opening 42 may also provide a cushion for improved comfort. Although the coupler 20 is illustrated as attaching the shaving razor cartridge 24 to the tottle 18, the coupler 20 may be used to attach other personal care articles to the tottle 18 or other fluid liquid dispensers.

During the act of shaving another person's face, a shaving razor must be put down numerous times as the care giver re-positions the person being shaved. When a person is shaving themselves, they rarely put down the shaving razor between strokes. Typically, the user only puts the razor down when they are finished shaving themselves. Conventional shaving razor systems are designed to rest horizontally on a flat surface. However, this may result in contamination of the razor. Used razor cartridges may carry blood borne pathogens and present a cross infection risk for the care giver or other individuals within close proximity. This is especially dangerous for individuals with suppressed immunity. Furthermore, care givers typically shave people in their rooms, not necessarily at a bathroom sink or counter top. Accordingly, the shaving razor system may need to rest on a surface that is not easily cleaned off.

Figure 2A:
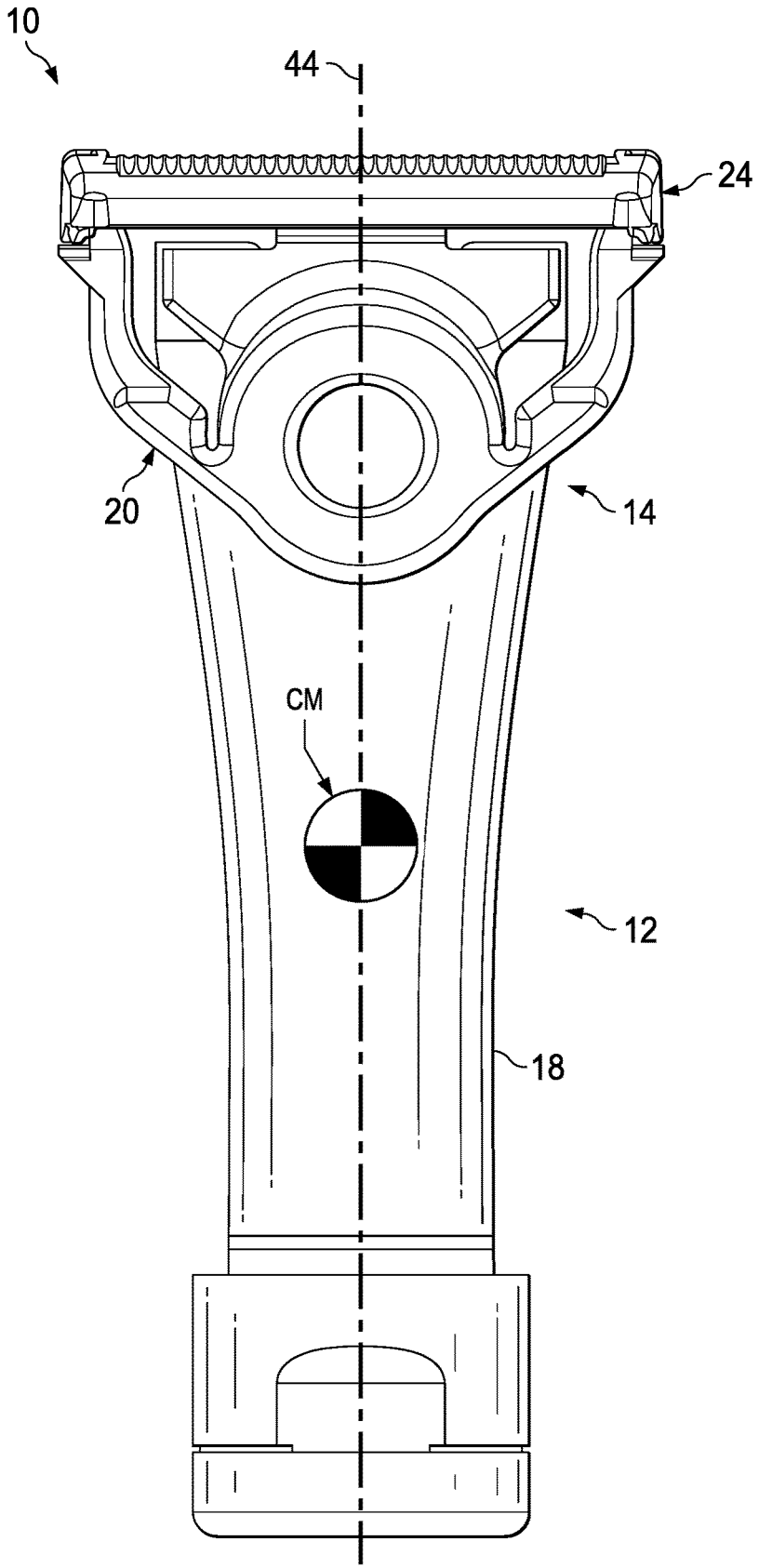
FIG. 2A is a side view of the shaving razor system of FIG. 1 in a standing position.

Referring to FIG. 2A the shaving razor system 10 of FIG. 1 is shown in an upright, vertical position. When the tottle 18 of the shaving razor system 10 is full, the shaving razor system 10 may have a center of mass "CM". The center of mass "CM" may lie along a center longitudinal axis 44 of the shaving razor system 10 (i.e., approximate center line extending along a length of the shaving razor system 10). The center of mass "CM" may be calculated in a full or empty condition for the tottle 18. For example, the center longitudinal axis 44 may be calculated by extending a line from the center of mass to a center of the bottom surface 50. It is understood that as liquid is removed from the tottle 18, the center of mass "CM" may shift, making the shaving razor system 10 easier to tip over. Furthermore, the added weight at the first end 14 of the handle 12 (e.g., the coupler 20 and the cartridge 24) may also make the shaving razor system 10 easier to tip over. Tottles generally do not have components added to an end opposite the fluid opening and thus do not experience tipping issues.

Figure 2B:
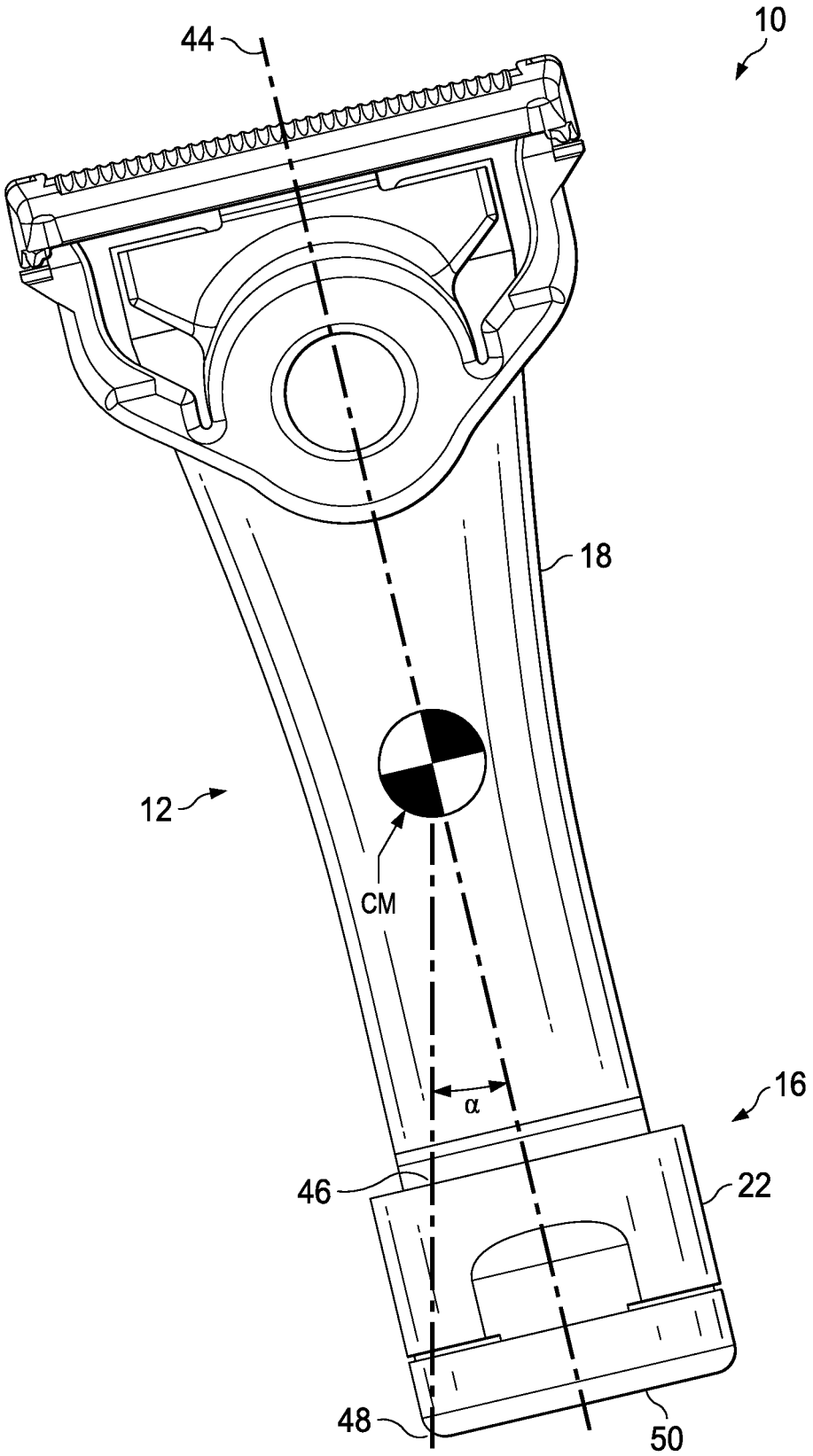
FIG. 2B is a side view of the shaving razor system of FIG. 1 in a tipped position.

Referring to FIG. 2B the shaving razor system 10 is shown in a tipped position. The second end 16 of the handle 12 may rest on a flat surface, such as a countertop or desk. As will be described in greater detail below, the shaving razor system 10 may be designed to allow for a tip angle "a" of about 10 degrees to about 15 degrees to prevent the shaving razor cartridge 24 from contacting the surface the handle 12 may rest on. In certain embodiments, the tipping angle "a" may be determined as the angle between the center longitudinal axis 44 passing through the center of mass "CM" and a line 46 extending from an outer edge 48 of a bottom surface 50 of the handle 12 (e.g., the end cap 22) through the center of mass "CM". The tipping angle "$\alpha$" may be calculated as an average of the tottle 18 in a full or empty condition. In certain embodiments, the shaving razor system 10 may have a mass of about 10 grams to about 40 grams in a full or empty condition.

Figure 3A:
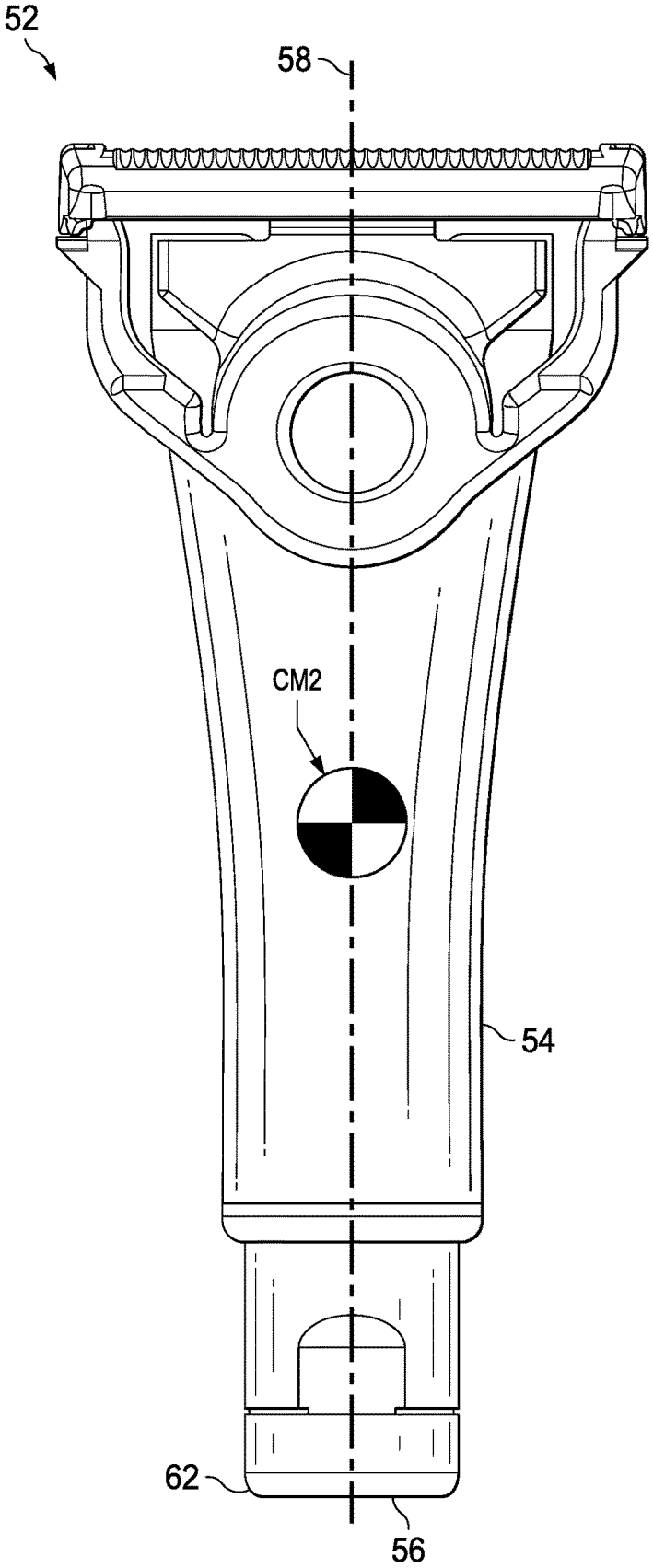
FIG. 3A is a side view of another possible embodiment of a shaving razor system in a standing position.
Figure 3B:
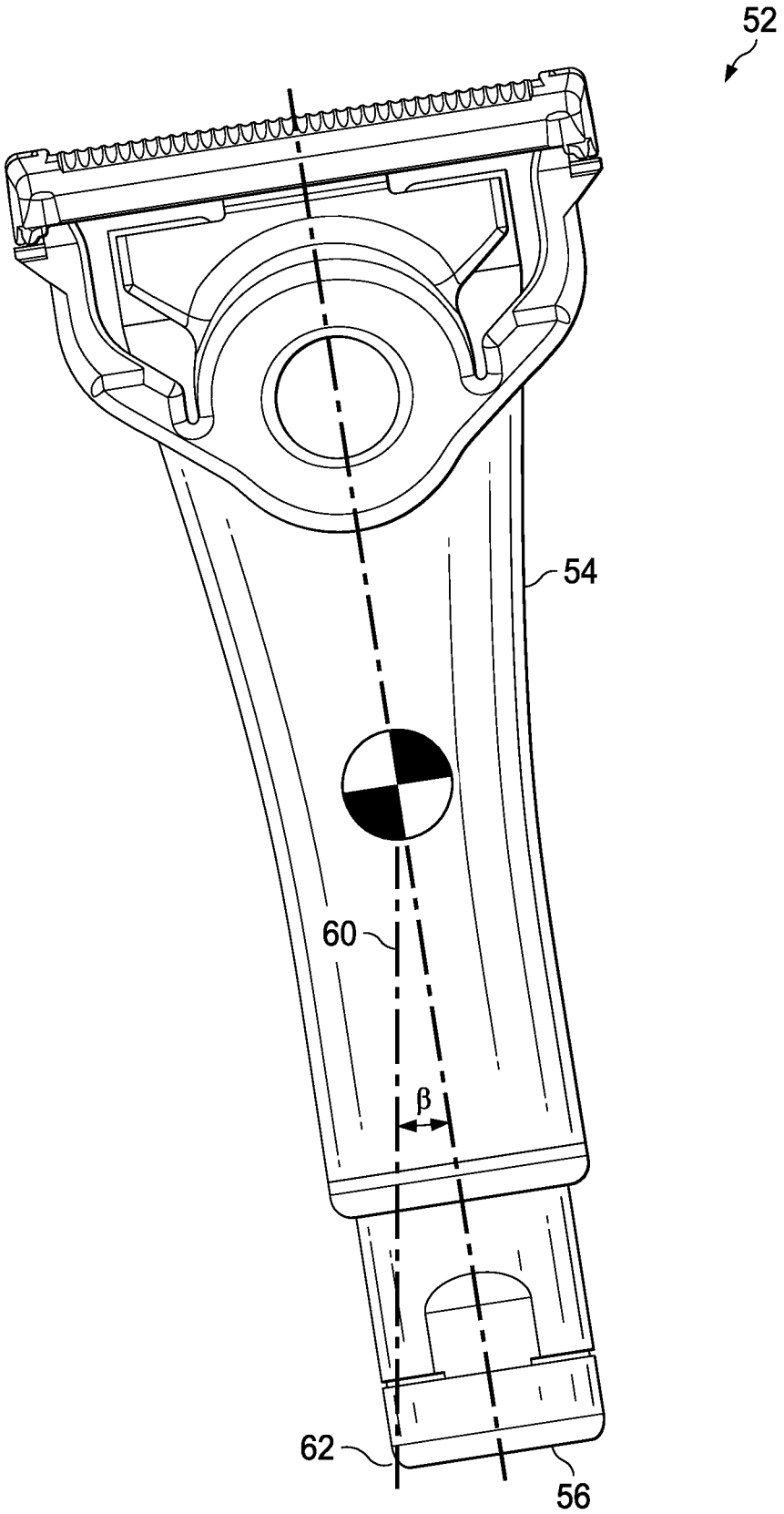
FIG. 3B is a side view of the shaving razor system of FIG. 3A in a tipped position.

The bottom surface 50 of the handle 12 may facilitate the shaving razor system 10 to be maintained in a standing upright position. The bottom surface 50 may be enlarged to allow the shaving razor system 10 to resist tipping (e.g., enable a larger tip angle). Razor systems are typically not designed to stand in an upright position without utilizing an external support, such as a stand. Furthermore, tottles typically have a bottom surface that is less than a cross sectional area of the tottle body. For example, FIGS. 3A and 3B illustrate a shaving razor system 52 having a tottle 54 with a smaller bottom surface 56. Accordingly, a tipping angle "$\beta$" of the shaving razor system 52 shown in FIGS. 3A and 3B is much less than the tipping angle "$\alpha$" of the shaving razor system 10 shown in FIGS. 2A and 2B. As shown in FIG. 3B, the tipping angle "$\beta$" of the shaving razor system 52 may be about 7 degrees, as measured from the center longitudinal axis 58 passing through a center of mass "CM2" of the tottle 54 and a line 60 extending from an outer edge 62 of the bottom surface 56 through the center of mass "CM2". A single use shaving razor system (such as the shaving razor system 10) with tottles are more likely to tip over because of the relatively small size of the tottle (e.g., contains less fluid and thus less mass) and the larger relative weight of the razor cartridge and attachment components. Furthermore, smaller tottles typically have a smaller bottom surface.

Figure 4A:
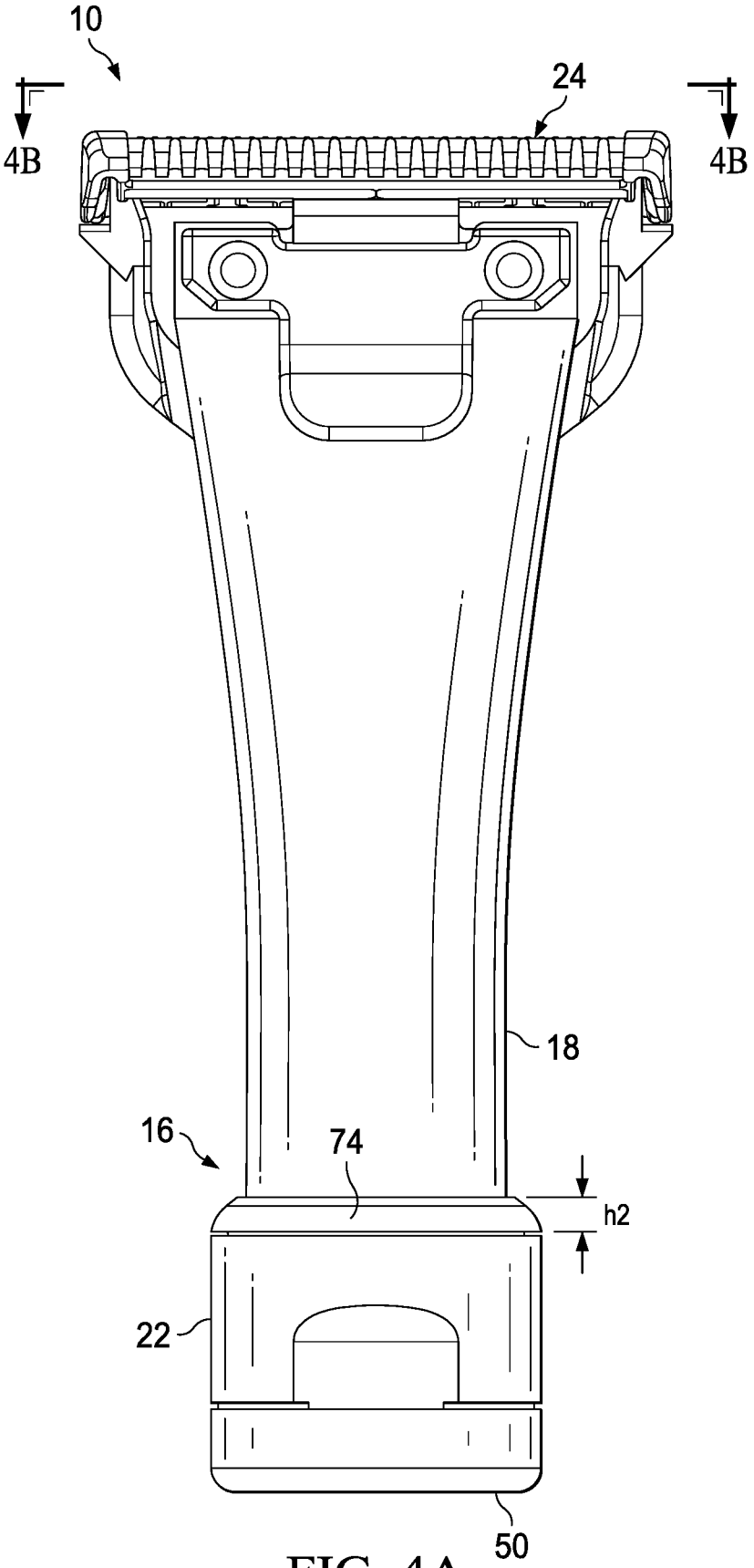
FIG. 4A is a rear view of the shaving razor system of FIG. 1.
Figure 4B:
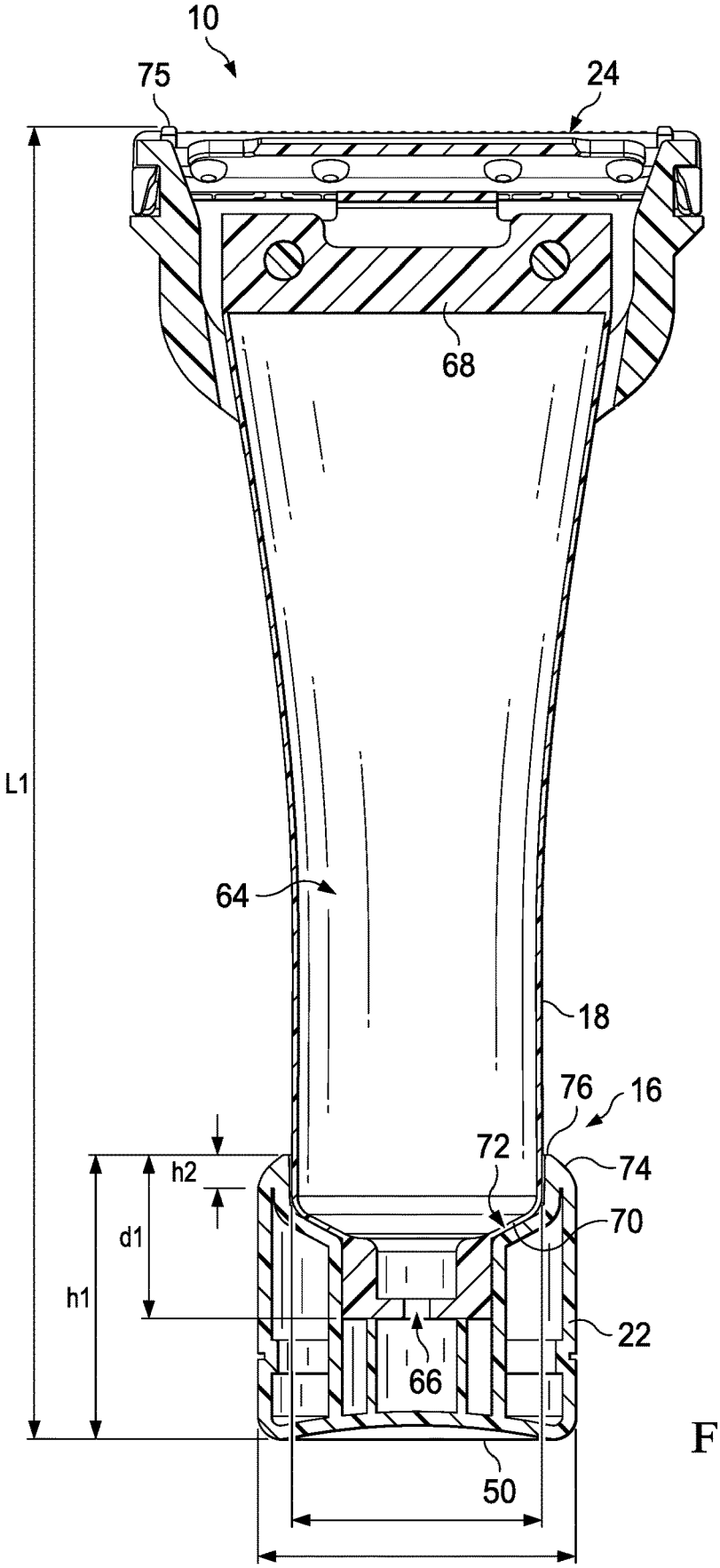
FIG. 4B is a cross sectional view of the shaving razor system of FIG. 1 taken generally along the line 4-4 of FIG. 1.

Referring to FIGS. 4A and 4B, a rear view and a cross sectional view of the shaving razor system 10 are shown, respectively. The end cap 22 may be mounted to the second end 16 of the tottle 18 by press fitting, threaded connections, ultra-sonic welding or other commonly known assembly methods. The tottle 18 may define a cavity 64 containing a liquid, such as a pre- or post-shave composition. The tottle 18 may have a fluid port 66 at one end and a seal 68 at an opposite end. The tottle 18 may have a maximum cross-sectional area between the seal 68 and the fluid port 66. The maximum cross-sectional area of the tottle 18 is typically toward the fluid port 66 because the cross-sectional area near the seal 68 typically flattens out and becomes smaller to allow the tottle 18 to be sealed. The bottom surface 50 (e.g., of the end cap 22) may have a contact area greater than the maximum cross-sectional area of the tottle 18 to provide improved stability (resist tipping). The contact area may be the projected footprint of the bottom surface 50. Accordingly, recesses, concavities, and openings may not decrease the contact area of the bottom surface even though a portion of the bottom surface is not in physical contact with a resting surface.

In certain embodiments, a ratio of the contact area of bottom surface 50 to the maximum cross-sectional area of the tottle 18 may be greater than 1.0. For example, the ratio of the maximum cross sectional of the tottle 18 to the contact area of the bottom surface may be about 1.1 to about 9.0 and more preferably about 1.1 to about 2.0 or about 1.1 to about 1.7. It is understood that the contact area may represent the overall footprint of the bottom surface 50. Accordingly, openings or recesses in the bottom surface 50 may not change the contact area. In certain embodiments, the contact area of the bottom surface 50 may be about 0.28 $cm^2$ to about 14 $cm^2$.

The tottle 18 may have a rim 70 that tapers to a smaller cross-sectional area of the fluid port 66. The end cap 22 may be positioned over the rim 70 to capture a greater length of the tottle 18 and provide improved stability. For example, the end cap 22 may define a recess 72 dimensioned to receive rim 70 of the tottle 18. The recess may have a depth "d1" that is at least 20% of a height "h1" of the end cap 22. For example, the depth "d1" may be about 50% to 75% of the height "h1" of the end cap 22. The end cap 22 may have a shoulder 74 that tapers to a top edge 76. The shoulder 74 may provide a gripping area for a user to position their fingers when holding the shaving razor system 10. In certain embodiments, the shoulder 74 may have a height h2 extending around the tottle 18 (or end cap 22) of at least 1 mm and more preferably, at least 3 mm. The shaving razor system 10 may have overall length "L1" extending from and an end 25 of the cartridge 24 to the bottom surface 50. The end cap 22 may be positioned over a length of the tottle that is at least 10% of the overall length "L1" of the tottle 18. For example, the end cap 22 may be positioned over a length of the tottle that is about 10% to about 25% of the overall length "L1" of the shaving razor system 10 to further prevent tipping.

Figure 5:
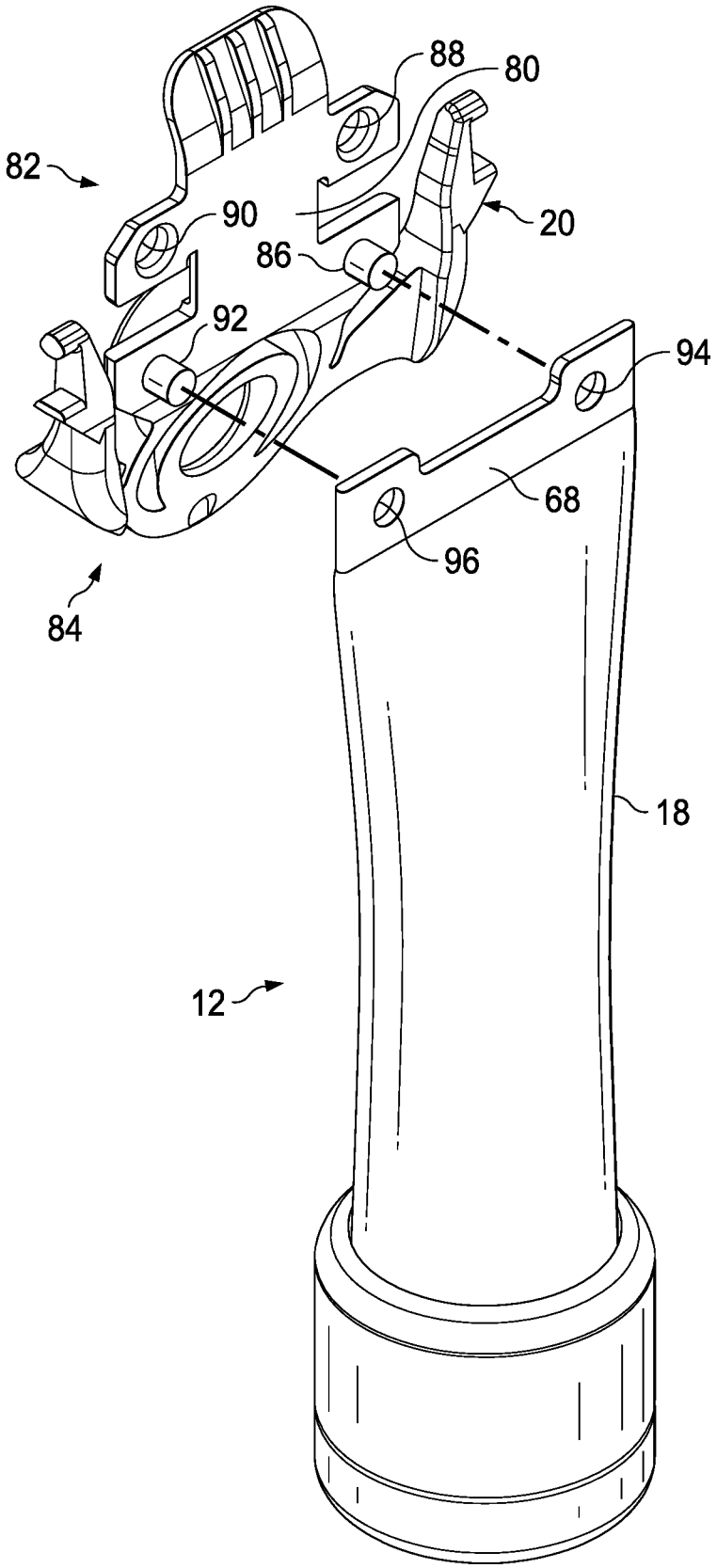
FIG. 5 is an assembly view of a tottle and a coupler of the shaving razor system of FIG. 1.

Referring to FIG. 5, a perspective assembly view is shown of the handle 12. The coupler 20 may be mounted to the seal 68 of the tottle 18. The coupler 20 may have a flexible hinge 80 between an upper portion 82 and a lower portion 84. The coupler 20 may have a first alignment pin 86 and a corresponding alignment hole 88. The first alignment pin 86 may be positioned on the lower portion 84 and the alignment hole 88 may be positioned on the upper portion 82. It is understood that the coupler 20 may have a plurality of alignment holes and corresponding alignment pins. For example, the upper portion 82 may include a second alignment hole 90 and the lower portion 84 may have a corresponding alignment pin 92. A plurality of alignment pins 86 and 92 may provide more improved positioning of the coupler 20 to the tottle 18 during assembly, as well as, improved securement of the coupler 20 to the tottle 18. For example, the pair of alignment pins 86 and 92 may better resist rotation of the coupler 20 during assembly and/or during use.

Figure 6:
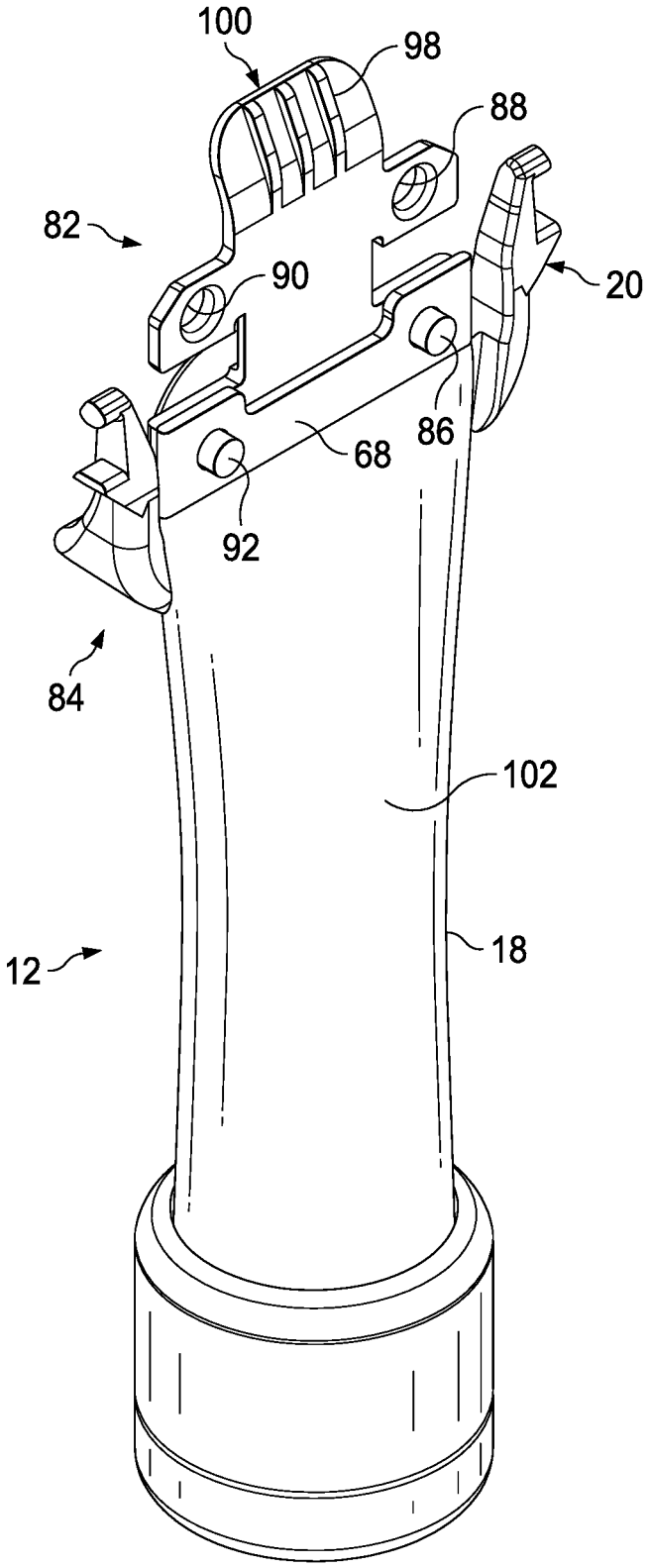
FIG. 6 is a perspective view of the tottle and the coupler in a first position.

Now referring to FIGS. 5 and 6, perspective assembly views of the handle 12 are shown. FIG. 5 illustrated the coupler 20 prior to being mounted to the tottle 18. FIG. 6 illustrates the coupler 20 mounted to the tottle 18. The seal 68 may define one or more openings 94 and 96 configured to receive the corresponding alignment pins 86 and 92 in a first position (e.g., an open position). The coupler 20 may be mounted to the top surface 36 (see FIG. 1) and the alignment pins 86 and 92 may be positioned within the openings 94 and 96 of the seal 68. In the first position, the upper portion 82 may be spaced apart from the lower portion 84. Accordingly, the alignment holes 88 and 90 are spaced apart and not engaged with the alignment pins 86 and 92, in the first position.

Figure 7:
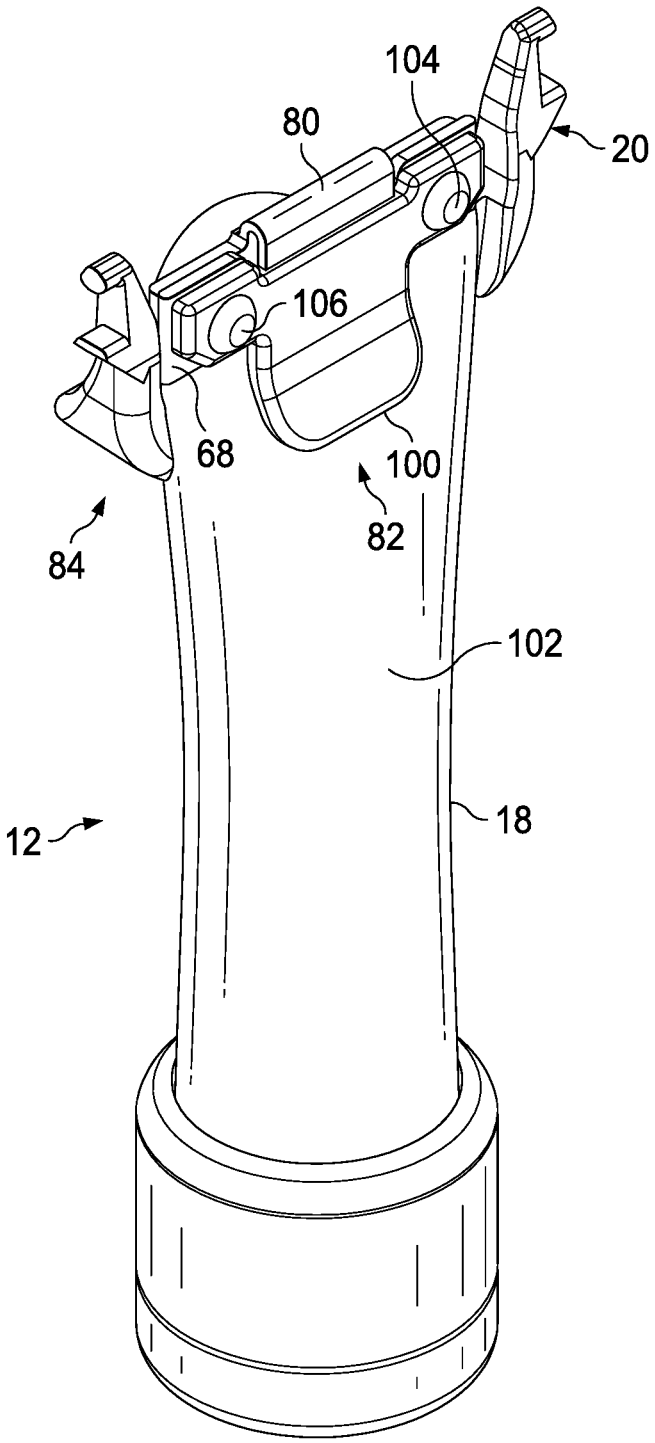
FIG. 7 is a perspective view of the tottle and the coupler in a second position.

The coupler 20 may have a second position (e.g., close position) with the upper portion 82 engaged with the lower portion 84. The upper portion 82 may be pivoted or flexed to engage with the lower portion 84. For example, the alignment pins 86 and 92 may be positioned within the corresponding alignment holes 88 and 90 and also within the openings 94 and 96 of the seal 68 (FIG. 7). The upper portion 82 may have a plurality of ribs 98 on a rigid tab 100, which may help provide an improved seal against the tottle 18. For example, the upper portion may be compressed against the tottle 18 (in the second position) causing the ribs 98 to clamp against the tottle 18 and material on a bottom surface 102 of the tottle 18 to be compressed between the ribs 98. The upper portion 82 may be sealed against the lower portion 84, as shown in FIG. 7. The flexible hinge 80 may flex to allow movement between the first and second positions. FIG. 7 illustrates the flexible hinge 80 in the flexed position. In the second position, one or more of the alignment pins 86 and 92 (shown in FIG. 6) may be cold staked, forming rivets 104 and 106 on the alignment pins 86 and 92, thus securing the upper portion 82 to the lower portion 84 and securing the coupler 20 to the tottle 18. Other permanent or temporary securing methods may also be used, such as, adhesives, ultra-sonic welding, snap fitting, press fitting and hot staking. It is understood that the shaving razor system may be provided as a kit that can be assembled by a consumer or is a complete unit. In other embodiments, the coupler 20 and the razor cartridge 24 (FIG. 1) may be sold together as a kit that can be attached to a tottle of the consumer's choice.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor system comprising:

a tottle defining a cavity for containing a liquid, the tottle having a second end defining a fluid port and a first end having a seal, the tottle having a maximum cross-sectional area between the seal and the fluid port;

a coupler mounted to the first end of the tottle;

a shaving razor cartridge mounted to the coupler, the shaving razor cartridge having at least one blade;

an end cap mounted to the second end of the tottle over the fluid port, wherein the end cap has a bottom surface configured to rest on a flat surface, with a contact area greater than the maximum cross-sectional area of the tottle, and wherein a ratio of the maximum cross-sectional area of the tottle to the contact area of the end cap is about 1.1 to about 9.0.

2. The shaving razor system of claim 1, wherein the ratio of the maximum cross-sectional area of the tottle to the contact area of the end cap is about 1.1 to about 2.0.

3. The shaving razor system of claim 1, wherein the contact area is about 0.28 $cm^2$ to about 14 $cm^2$.

4. The shaving razor system of claim 1 wherein the tottle has a rim toward the first end that tapers to a smaller cross-sectional area of the fluid port.

5. The shaving razor system of claim 4 wherein the rim is positioned within the end cap.

6. The shaving razor system of claim 1, wherein the end cap defines a recess dimensioned to receive the fluid port, the recess having a depth that is at least 10% of a height of the end cap.

7. The shaving razor system of claim 1 wherein a top edge of the end cap tapers outward to a shoulder of the end cap.

8. The shaving razor system of claim 7 wherein the shoulder has a height of at least 1 mm.

9. The shaving razor system of claim 7 wherein the shoulder has a height of at least 3 mm.

10. The shaving razor system of claim 1, wherein an angle between a center longitudinal axis of the shaving razor system passing through a center of mass of the shaving razor system and a line extending from the center of mass to an outer edge of the bottom surface is about 10 degrees to about 15 degrees when the cavity is in a full or an empty condition.

11. The shaving razor system of claim 1, wherein the tottle has an overall length extending from the seal to the fluid port and the end cap is positioned over a length that is at least 10% of the overall length of the tottle.

12. The shaving razor system of claim 11 wherein the end cap is positioned over a length that is 10% to 25% of the overall length of the tottle.

13. The shaving razor system of claim 1, wherein the shaving razor system has a mass of about 10 grams to about 40 grams when the cavity is in a full condition.

14. The shaving razor system of claim 1 wherein the end cap defines a recess dimensioned to receive the first end of the tottle, the recess having a depth that is about 10% to about 95% of a height of the end cap.

15. A shaving razor system comprising:

a tottle defining a cavity for containing a liquid, the tottle having a second end defining a fluid port and a first end having a seal, the tottle having a maximum cross-sectional area between the seal and the fluid port;

a coupler mounted to the first end of the tottle;

a shaving razor cartridge mounted to the coupler, the shaving razor cartridge having at least one blade;

an end cap mounted to the second end of the tottle over the fluid port, wherein the end cap has a bottom surface with a contact area greater than the maximum cross-sectional area of the tottle, wherein a ratio of the contact area of the end cap to the maximum cross-sectional area of the tottle is about 1.1 to about 2.0, and wherein an angle between a center longitudinal axis of the shaving razor system passing through a center of mass of the shaving razor system and a line extending from the center of mass to an outer edge of the bottom surface is about 10 degrees to about 15 degrees when the cavity is in a full or an empty condition.

16. The shaving razor system of claim 15 wherein the tottle has an overall length extending from the seal to the fluid port, and wherein the end cap is positioned over a length that is at least 10% of the overall length of the tottle.

17. The shaving razor system of claim 16 wherein and the end cap is positioned over a length that is 10% to 25% of the overall length of the tottle.

* * * * *